US010995605B2

(12) United States Patent
Sun et al.

(10) Patent No.: US 10,995,605 B2
(45) Date of Patent: May 4, 2021

(54) METHOD AND SYSTEM FOR STICK-SLIP MITIGATION

(71) Applicant: Halliburton Energy Services, Inc., Houston, TX (US)

(72) Inventors: Zhijie Sun, Spring, TX (US); Qiuying Gu, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/407,345

(22) Filed: May 9, 2019

(65) Prior Publication Data

US 2019/0368332 A1 Dec. 5, 2019

Related U.S. Application Data

(60) Provisional application No. 62/678,901, filed on May 31, 2018.

(51) Int. Cl.
*E21B 44/04* (2006.01)
*E21B 3/02* (2006.01)
*E21B 47/18* (2012.01)

(52) U.S. Cl.
CPC ..... *E21B 44/04* (2013.01); *E21B 3/02* (2013.01); *E21B 47/18* (2013.01)

(58) Field of Classification Search
CPC ..... E21B 44/04
USPC ..... 175/24
See application file for complete search history.

(56) References Cited

U.S. PATENT DOCUMENTS 5,406,474 A * 4/1995 Hansen ..... G05B 13/045 700/37
8,950,512 B2 2/2015 Nessjoen et al.
9,581,008 B2 2/2017 Kyllingstad
2012/0234605 A1* 9/2012 Donderici ..... G01V 1/46 175/73
2015/0240615 A1* 8/2015 Dykstra ..... G05D 17/02 700/275
2016/0138382 A1* 5/2016 Badkoubeh ..... E21B 44/04 175/24
2018/0073344 A1* 3/2018 Patterson ..... E21B 3/02
2018/0128093 A1* 5/2018 Jeffryes ..... G05B 19/0426

OTHER PUBLICATIONS

Dynamic Drilling Solutions, NOV stick-slip prevention service effectively reduces downhole vibrations and smooths the downhole drilling environment on the Montney Shale, National Oilwell Varco, LP., 2015.

* cited by examiner

*Primary Examiner* — Taras P Bemko
(74) *Attorney, Agent, or Firm* — Benjamin Ford; C. Tumey Law Group PLLC

(57) ABSTRACT

A method and system for dampening a stick-slip vibration. The method may comprise determining at least one frequency of a stick-slip vibration; determining mechanical properties of the drilling system; producing a torque signal from a controller having at least a second order; controlling a rotational speed of a top drive from the torque signal produced by the controller; and damping stick-slip vibration of the drilling system. The system may further comprise a drill string and a bottom hole assembly may be connected to the drill string. A drill bit may be connected to the bottom hole assembly and an information handling system may be connected to the drilling system.

20 Claims, 5 Drawing Sheets

METHOD AND SYSTEM FOR STICK-SLIP MITIGATION

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Subterranean drilling apparatuses such as drill bits, drill strings, bottom-hole assemblies (BHAs), and/or downhole tools may contact the borehole wall in such a way that they become caught or lodged in the borehole wall, causing the drill string to "stick." When the drilling apparatus "sticks," the rotational movement of the drill string is either stopped or severely decreased. Torque is still imparted to the drill string at the surface, despite the drilling apparatus being stuck, causing the drill string to twist. Once the torque applied to the drill string overcomes the force of static friction on the drilling apparatus, the drill string "slips" or releases from the borehole wall. This phenomenon may decrease the lifespan of downhole components, decrease the quality of the borehole, and delay the drilling operation.

BRIEF DESCRIPTION OF THE DRAWINGS

These drawings illustrate certain aspects of the presented disclosure and should not be used to limit or define the disclosure.

DETAILED DESCRIPTION

The present disclosure is directed to downhole tools and more particularly to systems and methods for observing stick-slip frequencies and dampening stick-slip across a wide frequency range. Controlling stick-slip across a drilling system may prevent premature wear and tear across the entire drilling system.

Figure 1:
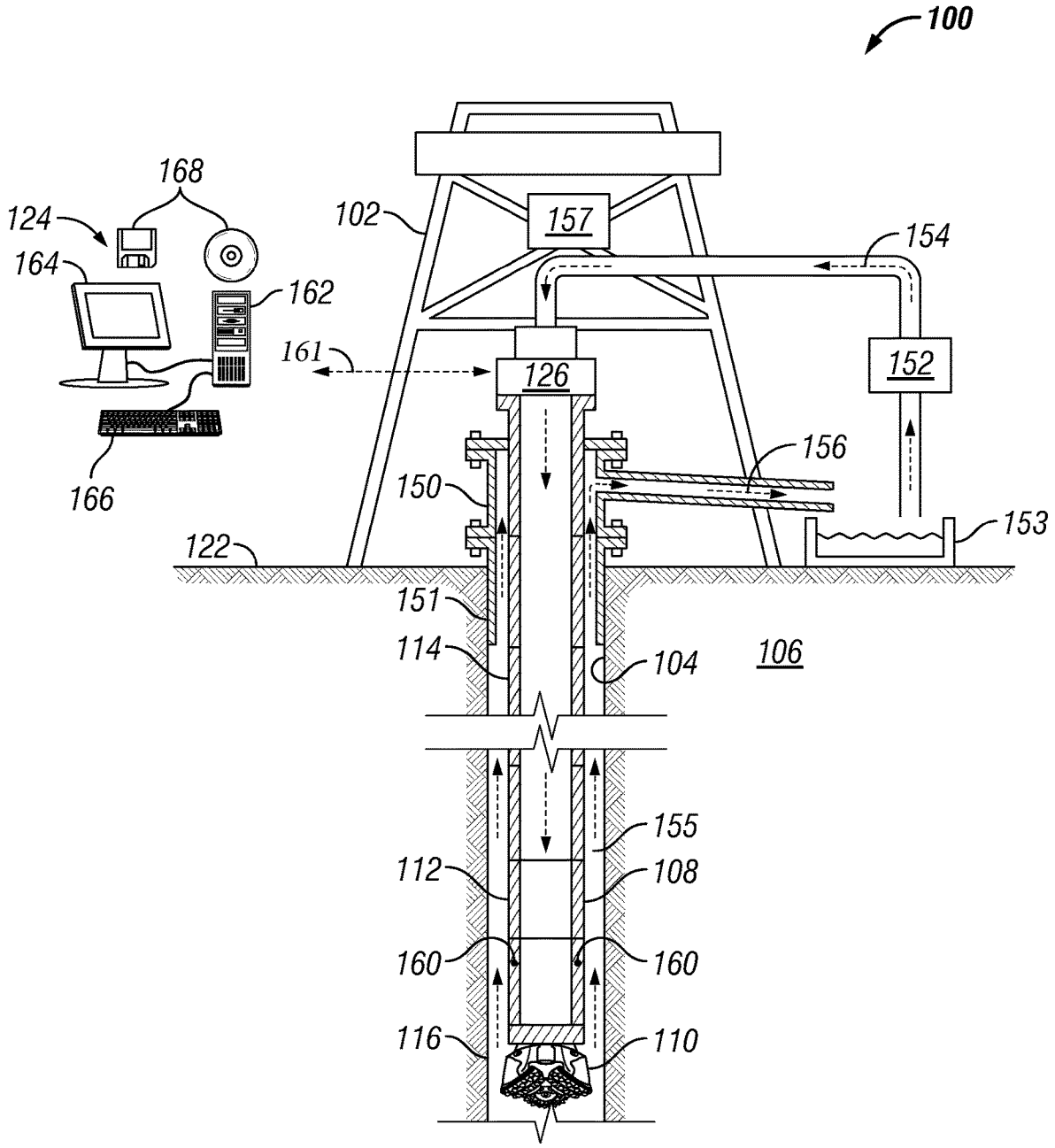
FIG. 1 illustrates an example of a drilling system.

FIG. 1 is a diagram of an example drilling system 100, according to aspects of the present disclosure. The drilling system 100 may include a rig 102 mounted at the surface 122, positioned above a borehole 104 within a subterranean formation 106. Although the surface 122 is shown as land in FIG. 1, the drilling rig of some examples may be located at sea, in which case the surface 122 would comprise a drilling platform. A drilling assembly may be at least partially disposed within the borehole 104. The drilling assembly may comprise a drill string 114, a bottom hole assembly (BHA) 108, a drill bit 110, and a top drive 126 or rotary table. The drill string 114 may comprise multiple drill pipe segments that may be threaded together. The BHA 108 may be coupled to the drill string 114, and the drill bit 110 may be coupled to the BHA 108. The top drive 126 may be coupled to the drill string 114 and impart torque and rotation to the drill string 114, causing the drill string 114 to rotate. Torque and rotation imparted on the drill string 114 may be transferred to the BHA 108 and the drill bit 110, causing both to rotate. The rotation of the drill bit 110 by the top drive 126 may cause the drill bit 110 to engage with or drill into subterranean formation 106 and extend the borehole 104. Other drilling assembly arrangements are possible, as would be appreciated by one of ordinary skill in the art in view of this disclosure.

The BHA 108 may include tools such as LWD/MWD elements 116 and telemetry system 112 and may be coupled to the drill string 114. The LWD/MWD elements 116 may comprise downhole instruments, including sensors 160 that measure downhole conditions. While drilling is in progress, these instruments may continuously or intermittently monitor downhole conditions, drilling parameters, and other formation data. Information generated by the LWD/MWD element 116 may be stored while the instruments are downhole, and recovered at the surface later when the drill string is retrieved. In certain examples, information generated by the LWD/MWD element 116 may be communicated to the surface using telemetry system 112. The telemetry system 112 may provide communication with the surface over various channels, including wired and wireless communications channels as well as mud pulses through a drilling mud within the borehole 104.

The drill string 114 may extend downwardly through a surface tubular 150 into the borehole 104. The surface tubular 150 may be coupled to a wellhead 151 and the top drive 126 may be coupled to the surface tubular 150. The wellhead 151 may include a portion that extends into the borehole 104. In certain examples, the wellhead 109 may be secured within the borehole 104 using cement, and may work with the surface tubular 150 and other surface equipment, such as a blowout preventer (BOP) (not shown), to prevent excess pressures from subterranean formation 106 and borehole 104 from being released at the surface 103.

During drilling operations, a pump 152 located at the surface 122 may pump drilling fluid from a surface reservoir 153 through the upper end of the drill string 114. As indicated by arrows 154, the drilling fluid may flow down the interior of drill string 114, through the drill bit 110 and into a borehole annulus 155. The borehole annulus 155 is created by the rotation of the drill string 114 and attached drill bit 110 in borehole 104 and is defined as the space between the interior/inner wall or diameter of borehole 104 and the exterior/outer surface or diameter of the drill string 114. The annular space may extend out of the borehole 104, through the wellhead 151 and into the surface tubular 150. The surface tubular 150 may be coupled to a fluid conduit 156 that provides fluid communication between the surface tubular 150 and surface reservoir 153. Drilling fluid may exit from the borehole annulus 155 and flow to surface reservoir 153 through the fluid conduit 156.

In certain examples, at least some of the drilling assembly, including the drill string 114, BHA 108, and drill bit 110 may be suspended from the rig 102 on a hook assembly 157. The total force pulling down on the hook assembly 157 may be referred to as the hook load. The hook load may correspond to the weight of the drilling assembly reduced by any force that reduces the weight. Example forces include friction along the wellbore wall and buoyant forces on the drill string 114 caused by its immersion in drilling fluid. When the drill bit 110 contacts the bottom of subterranean formation 106, the formation will offset some of the weight of the drilling assembly, and that offset may correspond to the weight-on-bit of the drilling assembly. The hook assembly 157 may include a weight indicator that shows the amount of weight suspended from the hook assembly 157 at a given time. In certain examples, the hook assembly 157 may include a winch, or a separate winch may be coupled to the hook assembly 157, and the winch may be used to vary the hook load/weight-on-bit of the drilling assembly.

In certain examples, the drilling system 100 may comprise an information handling system 124 positioned at the surface 122. The information handling system 124 may be communicably coupled to one or more controllable elements of the drilling system 100, including the pump 152, hook assembly 157, LWD/MWD elements 116, and top drive 126. Controllable elements may comprise drilling equipment whose operating states may be altered or modified through an electronic control signal. The information handling system 124 may comprise an information handling system that may at least partially implement a control system or algorithm for at least one controllable element of the drilling system 100.

In certain examples, the information handling system 124 may receive inputs from the drilling system 100 and output one or more control signals to a controllable element. The control signal may cause the controllable element to vary one or more drilling parameters. Example drilling parameters include drilling speed, weight-on-bit, and drilling fluid flow rate. The control signals may be directed to the controllable elements of the drilling system 100 generally, or to actuators or other controllable mechanisms within the controllable elements of the drilling system 100 specifically. For example, the top drive 126 may comprise an actuator through which torque imparted on the drill string 114 is controlled. Likewise, hook assembly 157 may comprise an actuator coupled to the winch assembly that controls the amount of weight borne by the winch. In certain examples, some or all of the controllable elements of the drilling system 100 may include limited, integral control elements or processors that may receive a control signal from the information handling system 124 and generate a specific command to the corresponding actuators or other controllable mechanisms.

In the embodiment shown, control signals may be directed to one or more of the pump 152, the hook assembly 157, the LWD/MWD elements 116, and the top drive 126. A control signal directed to the pump 152 may vary the flow rate of the drilling fluid that is pumped into the drill string 114. A control signal directed to the hook assembly 157 may vary the weight-on-bit of the drilling assembly by causing a winch to bear more or less of the weight of the drilling assembly. A control signal directed to the top drive may vary the rotational speed of the drill string 114 by changing the torque applied to the drill string 114. A control signal directed to the LWD/MWD elements 116 may cause the LWD/MWD elements 116 to take a measurement of subterranean formation 106 or may vary the type or frequency of the measurements taken by the LWD/MWD elements 116. Other control signal types would be appreciated by one of ordinary skill in the art in view of this disclosure.

As illustrated, information handling system 124 may communicate with BHA 108 through a communication link 161 (which may be wired or wireless, for example) Information handling system 124 may include a processing unit 162, a monitor 164, an input device 166 (e.g., keyboard, mouse, etc.), and/or computer media 168 (e.g., optical disks, magnetic disks) that may store code representative of the methods described herein. In addition to, or in place of processing at surface 122, processing may occur downhole.

Systems and methods of the present disclosure may be implemented, at least in part, with information handling system 140. While shown at surface 122, information handling system 140 may also be located at another location, such as remote from borehole 104 or downhole. Information handling system 140 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 140 may be a personal computer 144, a network storage device, or any other suitable device and may vary in size, shape, performance, functionality, and price. Information handling system 140 may include random access memory (RAM), one or more processing resources such as a central processing unit (CPU) or hardware or software control logic, ROM, and/or other types of nonvolatile memory. Additional components of the information handling system 140 may include one or more disk drives, one or more network ports for communication with external devices as well as various input and output (I/O) devices, such as a keyboard 148, a mouse, and a video display 146. Information handling system 140 may also include one or more buses operable to transmit communications between the various hardware components.

During drilling operations, drill bit 110 may experience stick-slip. Stick-slip may be defined as a spontaneous jerking motion that may occur while two objects may be sliding over each other. For example, as drill bit 110 rotates within subterranean formation 106, drill bit 110 may break, tear, drill, and/or grab into elements and/or materials that may comprise subterranean formation 106. Subterranean formation 106 may be made of hard and/or soft elements and/or material. As drill bit 110 rotates, a spontaneous jerking motion may occur as drill bit 110 slides across hard material and/or elements. Likewise, drill bit 110 may experience a spontaneous jerking motion as softer material and/or elements are crushed and removed faster than other material and/or elements around them. Stick-slip induced vibration may cause bit wear of drill bit 110, premature tool failure, and poor drilling performance. One way to mitigation stick-slip may be through smart control of top drive 126. Current technology may absorb vibration wave at a fundamental frequency by tuning a proportional-integral (PI) controller gains. However, it stick-slip induced vibrations may exist at more than one single frequency. Therefore, tuning a proportional-integral (PI) controller may not be enough. As discussed below, frequencies may be determined from surface measurements including top drive RPM and torque, calculation from a model, analyzing downhome measurement data, surface torque frequency map, pulsed downhole frequency information from a downhole sensor, and/or any combination thereof. Thus, a controller that may absorb the vibration waves at more than one fundamental frequency while regulating the drill string speed to the desired setpoint may be beneficial.

Downhole torsional vibration dynamics may be a main contributor to stick-slip dynamics. Stick-slip induced vibrational waves travel along drill string 114 back and forth between drill bit 110 and top drive 126. Therefore, torque at top drive 126 may be manipulated to mitigate the vibration of drill string 114 and also mitigate the stick-slip motion. In other words, it may absorb or attenuate the torsional vibration wave that travels towards it.

As discussed above, stick-slip induced vibrations do not exist at a single frequency, and a PI controller cannot mitigate stick/slip at all vibration frequencies. Vibrations at frequencies other than the one chosen for mitigation may even be amplified. To overcome the shortages of a PI controller, a controller with a wider bandwidth to attenuate multiple frequencies and better setpoint tracking ability is discussed below.

The torsional dynamics of a drill string may be modeled by a wave equation:

$$c^2\frac{\partial^2 u}{\partial x^2} = \frac{\partial^2 u}{\partial t^2} \tag{1}$$

where c is the wave speed and is equal to $\sqrt{G_M/\rho}$, assuming $G_M$ is the shear modulus and p is the density of drill string. It should be noted that u=u(x,t) may represent the rotation angle Ω(x, t). The general solution to the equation may be written as:

$$u(x, t) = f\left(t + \frac{x}{c}\right) + g\left(t - \frac{x}{c}\right) \tag{2}$$

where f and g are univariate function determined by initial and boundary conditions. f(·) is the wave travelling upwards carrying stick-slip signals, and g(·) is the wave travelling downwards. Applying the boundary condition at top drive x=0 gives:

$$J\ddot{u}|_{x=0} = F_T - F_C \tag{3}$$

where J is the equivalent top drive inertia, $F_T$ is the top drive torque output by a controller, and $$F_C = -G_M I \frac{\partial u}{\partial x}\bigg|_{x=0} \tag{4}$$

is the torque from the drill string. I is the second moment of area. Then, the boundary condition at top drive becomes:

$$J(f'' + g'')|_{x=0} = F_T + \frac{G_M I}{c}(f' - g')\bigg|_{x=0} \tag{5}$$

which is equivalent to:

$$F_T = J(f'' + g'') - \frac{G_M I}{c}(f' - g')\bigg|_{x=0} \tag{6}$$

It should be noted that top drive speed may be:

$$V = \frac{\partial u}{\partial x}\bigg|_{x=0} = (f' + g')|_{x=0} \tag{7}$$

Taking Laplace transform at top drive x=0 yields:

$$L\{u(t)\} = L\{f(t)\} + L\{g(t)\} \tag{8}$$

which is denoted by $$U_0(s) = F(s) + G(s) \tag{9}$$

Let the controller Gc(s) have a general form:

$$G_c = \frac{b_{mc}s^{mc} + b_{mc-1}s^{mc-1} + \ldots + b_{1c}s + b_{oc}}{a_{nc}s^{nc} + a_{nc-1}s^{nc-1} + \ldots + a_{1c}s + 1} \tag{10}$$

where mc≤nc to ensure causality. Additionally, nc≥2 is required so that Gc may not be in the form of proportional-integral (PI) control. Then, with RPM measurement as feedback which is denoted by V(s), the top drive torque Fr may be expressed by:

$$\begin{aligned} F_{T(s)} &= G_c(s)[R(s) - V(s)] \\ &= G_c(s)[R(s) - sU_o(s)] \\ &= G_c(s)[R(s) - s(F(s) + G(s))] \end{aligned} \tag{11}$$

where R(s) is the Laplace transform of setpoint r(t). Similarly, the torque from drill string Fc in frequency domain is written as:

$$F_C(s) = -\frac{G_M I}{C}s[F(s) - G(s)] \tag{12}$$

Boundary condition at x=0 in frequency domain:

$$Js^2(F + G) = s\left(-G_C + \frac{G_M I}{C}\right)F + s\left(-G_C - \frac{G_M I}{C}\right)G + G_C(s)R(s) \tag{13}$$

Therefore:

$$G(s) = \frac{-Js + \frac{G_M I}{C}G_C}{Js + \frac{G_M I}{C} + G_C}F(s) + \frac{G_C}{s\left(Js + \frac{G_M I}{C} + G_C\right)}R(s) \tag{14}$$

The first term describes the reflection of stick-slip wave at top drive, while the second term shows the setpoint tracking performance.

As shown above, a controller Gc may be designed that satisfies four objectives. A first objective may be a closed loop transfer function between the torsional wave transferred towards top drive (F(s)) and reflected back towards bit (G(s)) has a small magnitude at the observed stick-slip frequencies. A second objective may be that the controller may be tuned to control the bandwidth (the frequency band where stick-slip induced vibrations may be substantially mitigated) while maintaining attenuation level, so that it may cover the situation when the observed frequencies may be off the true stick-slip frequency within certain limits. A typical PI controller cannot independently control bandwidth without sacrificing attenuation level. A third objective may be to form a closed loop transfer function between the torsional wave transferred towards top drive (F(S)) and reflected back towards (G(s)) (e.g., drill bit 110) has no amplification at any frequencies. A fourth objective may be to form a closed loop transfer function between the setpoint R(s) and reflected back towards (G(s)) (e.g., drill bit 11) has steady state magnitude 1 within a finite settling time.

These objectives may remove constraints from a PI controller format where the system and method may begin with a general filter structure. This may allow the capability to extend to other filters to mitigate more than two frequencies.

For example, denote the desired characteristics of stick-slip reflection as:

$$G_{CL} = \frac{G(s)}{F(s)} \triangleq \frac{N(s)}{D(s)} \tag{15}$$

Hence $$\frac{-Js + \frac{G_M I}{C} - G_C}{Js + \frac{G_M I}{C} + G_C} = G_{CL} = \frac{N(s)}{D(s)} = \frac{b_m s^m + b_{m-1}s^{m-1} + \ldots + b_1 s + b_o}{s^n + a_{n-1}s^{n-1} + \ldots + a_1 s + a_o} \tag{16}$$

Controller Gc is solved to be:

$$G_C(s) = -Js + \frac{G_M I}{C}\frac{1 - G_{CL}}{1 + G_{CL}} = \frac{-Js(D+N) + \frac{G_M I}{C}(D-N)}{D+N} \tag{17}$$

In order for Ge to be causal, N and D have the same order, i.e., m=n. Coefficients of highest order of N and D may be complementary, (i.e., $b_m$=−1). Coefficients of second-highest order satisfy:

$$a_{m-1} + b_{m-1} = 2\frac{GI}{JC} \tag{18}$$

The equivalent physical meaning is first that the desired filter must be band stop, second the high-frequency gain of filter must be 1, phase shift must be −180°, and third the "high frequency" is defined by the highest-possible stick-slip frequency generated by drill bit 110 (e.g., referring to FIG. 1).

The desired characteristics of stick-slip reflection must satisfy the three requirements above. Otherwise, the controller may not be infeasible for implementation. Controller Gc may be implemented in through direct implementation, PI+filter implementation, and implementation by changing setpoint.

Figure 2:
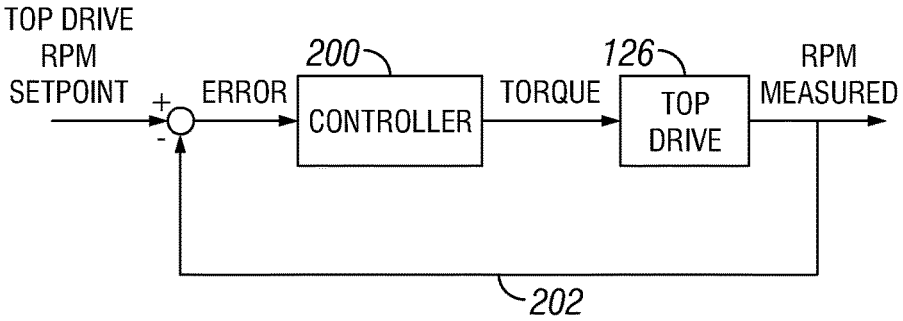
FIG. 2 illustrates an example of a system to detect and mitigate stick-slip.
Figure 3:
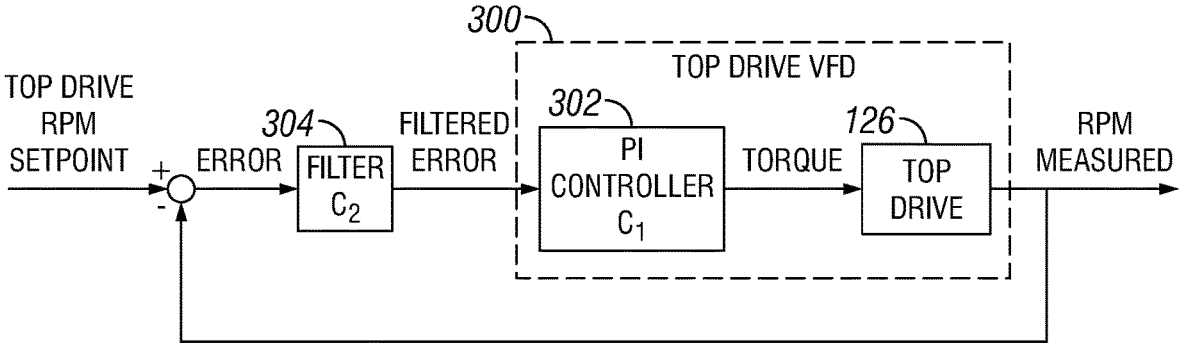
FIG. 3 illustrates another example of a system to detect and mitigate stick-slip.

FIG. 2 illustrates direct implementation. In direct implementation, controller 200 may control the torque of top drive 126 with a RPM feedback look 202. Since the order of Gc is greater than or equal to 2, it may be broken into two parts. A first part may be $C_1$ defined as a PI controller, and a second part C2 defined as the remaining high-order filter such that Gc=$C_1 \cdot C_2$. FIG. 3 illustrates two distinct parts. C1 is implemented in the variable-frequency drive (VFD) 300 of top drive 126 by providing P and I parameters in PI controller 302. Filter 304 comprising C2 may be feed into VFD 300 or may also be implemented on the RPM feedback loop 202 as illustrated in FIG. 4.

Figure 4:
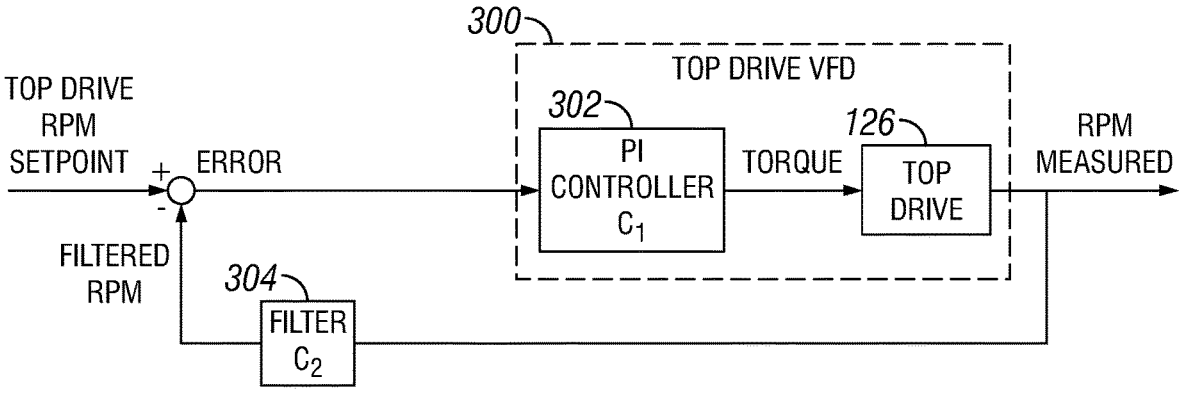
FIG. 4 illustrates another example of a system to detect and mitigate stick-slip.

FIG. 4 illustrates implementation with filter C2 on the feedback line. In this implementation, mathematically, equation for torque for top drive 126 may be modified to:

$$\begin{aligned} F_T &= C_1(s)[R(s) - C_2 V(s)] \\ &= C_1(s)[R(s) - C_2(s)\cdot s(F(s) + G(s))] \end{aligned} \tag{19}$$

since $$V(s) = L[u_0(t)] = sU_0 = s(F+G) \tag{20}$$

The boundary condition at top drive 126 becomes:

$$\begin{aligned} Js^2(F+G) = C_1[R - C_2\cdot s(F+G)] + \frac{G_M I}{c}s(F-G) = \\ s\left(-G_c + \frac{G_M I}{c}\right)F + s\left(-G_c - \frac{G_M I}{c}\right)G + C_1 R \end{aligned} \tag{21}$$

$$G(s) = \frac{-Js + G_M I/c - G_c}{Js + G_M I/G_c}F(s) + \frac{c_1}{s(Js + G_M I/c + G_c)}R(s) \tag{22}$$

It should be noted that the transfer function form F to G remains the same compared to direct implementation. Dynamics from setpoint R to rotational speed of reflected wave $\dot{G}$ becomes:

$$\frac{\dot{G}(s)}{R(s)} = \frac{C_1}{Js + G_M I/c + G_c} \tag{23}$$

FIG. 4 illustrates the signal flow within the control system. By manipulating the top drive torque to control the rpm, the observed stick-slip torsional wave may absorbed by top drive 126. The wave absorption at different frequencies may be tuned by adjusting the filter coefficients and optionally the parameters of PI controller. The filtered RPM measurement $C_2(s)V(s)$ is the feedback signal compared against the setpoint within the PI controller. Thus, filter 304 may be disposed with any existing PI controller within VFD 300.

Figure 5:
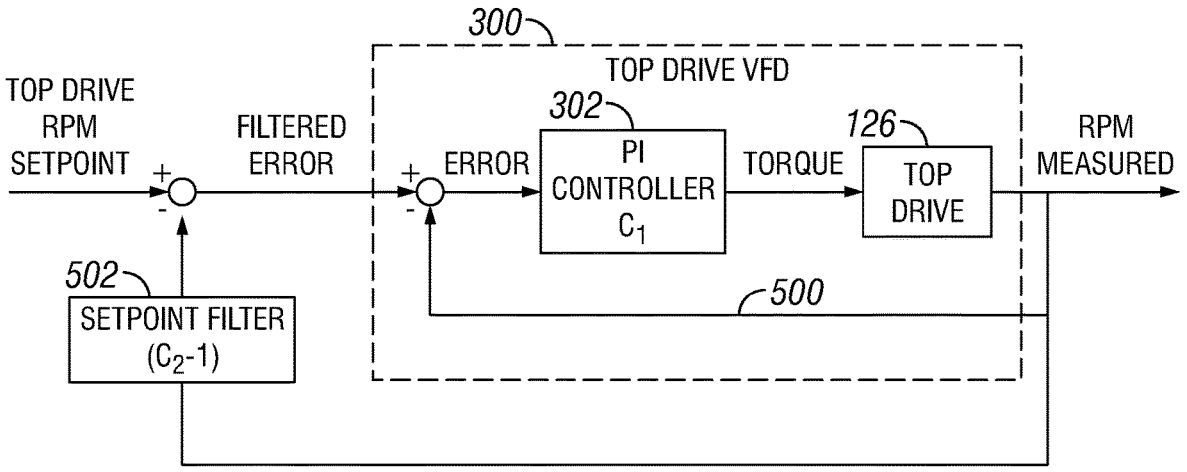
FIG. 5 illustrates another example of a system to detect and mitigate stick-slip.

It should be noted that implementation of PI controller 302 may not be limited to the FIGS. 2-4. In examples, the controller/filter may be converted to discretized-time domain for computer implementation. FIG. 5 illustrates an implementation where a setpoint is changed. This may be appropriate with top drive 126 of VFD 300 may have an internal feedback loop 500. Changing setpoint to VFD 300 may be required to implement Gc. In FIG. 5, the RPM measurement V(s) feed back into PI controller 302 controller through internal feedback loop 500, which may avoid any potential change need to be made in the VFD control. Instead, this measurement V(s) is pre-added to the RPM setpoint through filter ($C_2(s)$−1), identified as setpoint filter 502, to generate the filtered setpoint signal to feed into PI controller 302. The overall close loop transfer function remains the same.

A method to be implemented with this system may be begin with determining at least one frequency of stick-slip vibration. This may be done by analyzing surface measurements including top drive RPM and torque, calculation from a model, analyzing downhole measurement data, or a combination of the three. Another step may be determining mechanical properties of the drilling system. This may include equivalent top drive inertia, shear modulus, density and moment of drill string. An additional step may include determining a controller having at least second order that produces a torque signal. The controller may be designed according to the aforementioned design guideline; or found by trial and error until a satisfied stick-slip reflection characteristic is obtained; or determined by enumerating coefficients and selecting the one with best stick-slip reflection characteristic. Method steps may further include controlling the rotation of the top of drill string by outputting the torque produced by the controller. These steps may culminate to a step for damping stick-slip vibration of the drilling system 100 (e.g., referring to FIG. 1). These steps may be repeated when there exists a change in stick-slip vibration frequencies or mechanical parameters.

The current existing and the proposed vibration mitigation method requires the information about the system properties, include the top drive rotational inertia, drill pipe shear modulus, and density. Simulations illustrated in FIGS. 6-10 are done to show that the prosed controller is robust to perform the methods described above.

For example, given the mechanical properties of the system as $J=320\ kg\cdot m^2$, $\rho=7850\ kg/m^3$, and $I=1.3708\times10^{-5}\ m^4$. A method and system designed according to the above guidelines to attenuate stick-slip at 0.8 Hz and 3 Hz is simulated below where:

$$G_c = 1053\left(\frac{s^2+5997s+49.42}{s^2+3.29s+190.3}\right)\cdot\left(1+\frac{55.22}{s}\right) \tag{24}$$

Figure 6:
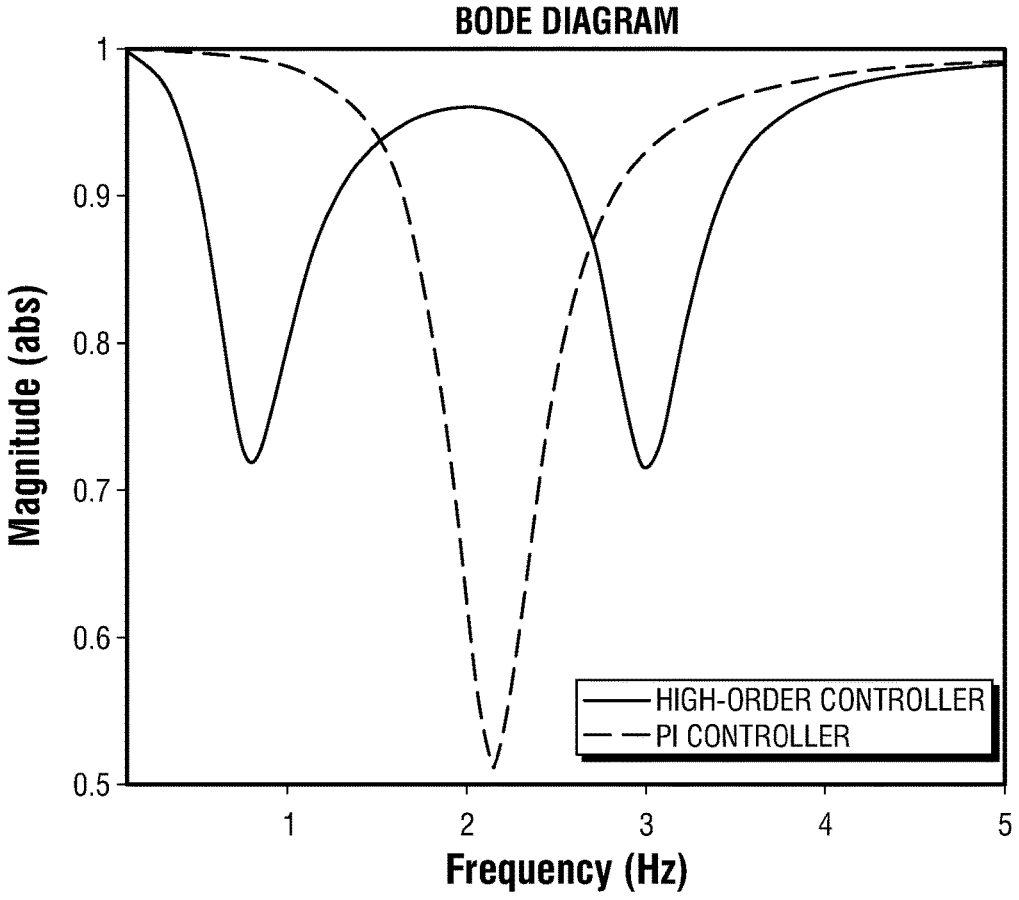
FIG. 6 is a graph of targeting multiple frequencies of stick-slip.

As illustrated in FIG. 6, the stick-slip at 0.8 Hz and 3 Hz may be simultaneously suppressed.

Figure 8:
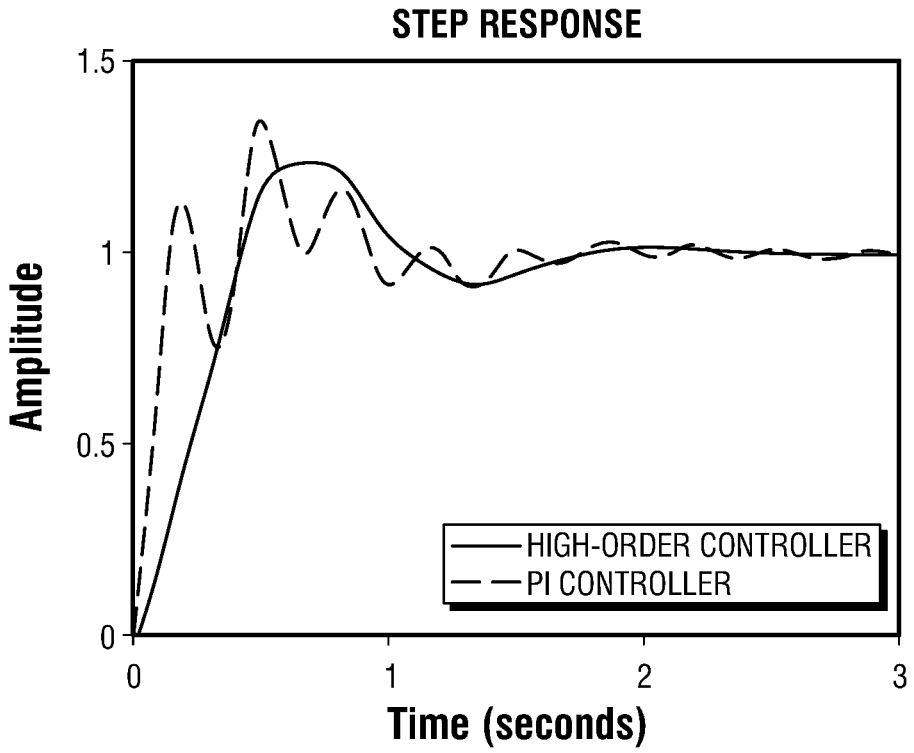
FIG. 8 is a graph showing another example of filtering stick-slip.

FIG. 8 illustrates a high-order controller separated into two parts (e.g., FIGS. 3 and 4), methods above may show:

$$C_2 = 3.8506\frac{s^2+5.997+49.42}{s^2+3.29s+190.3} \tag{25}$$

As a Filter and a PI Controller $$C_1 = 273.47\left(1+\frac{55.22}{s}\right) \tag{26}$$

For implementation of $C_2$ in FIG. 2-4 on a computing device, for example, a computer, a digital filter, or a field-programmable gate array (FPGA), given a sampling rate of 100 Hz, the continuous-time filter $C_2(s)$ is discretized as $$C_2(z) = \frac{z^2-1.929z+0.9342}{z^2-1.949z+0.9676} \tag{27}$$

With the discrete-time filter (27), the relation between error and filtered error in FIG. 4 is $$e_f(k)=e(k)-1.929e(k-1)+0.9342e(k-2)+1.949e_f(k)-0.9676e_f(k) \tag{28}$$

where $e_f(k)$ and $e(k)$ are filtered error and RPM error, respectively. k denotes time instant in discrete-time domain.

Figure 7:
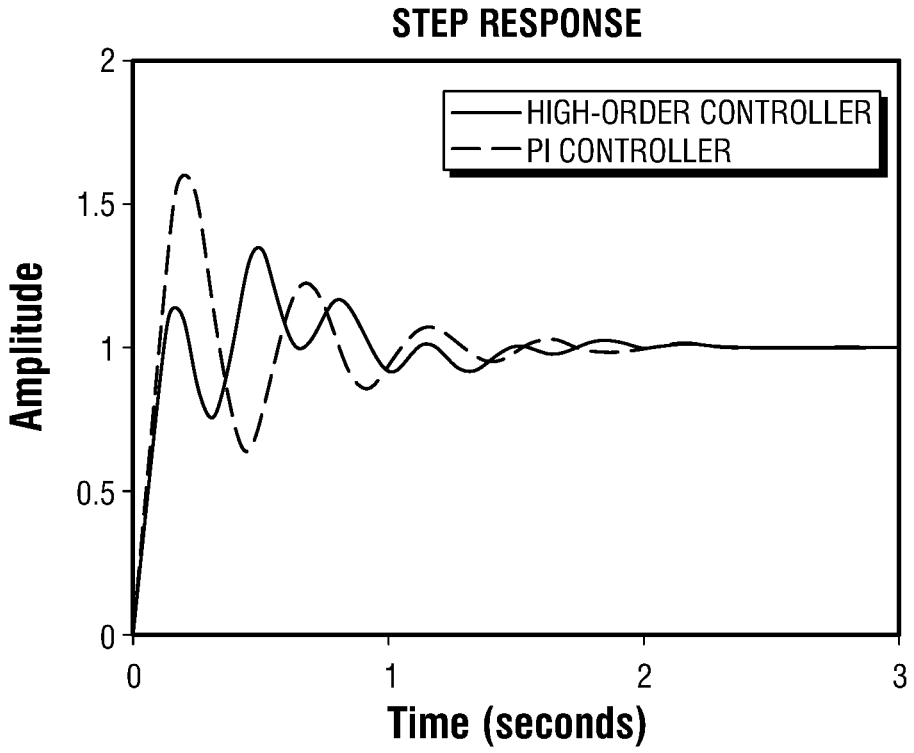
FIG. 7 is a graph showing examples of filtering stick-slip.

The setpoint tracking performance is illustrated in FIGS. 7 and 8 illustrate about the same settling time, less oscillation, and less overshot.

Figure 9:
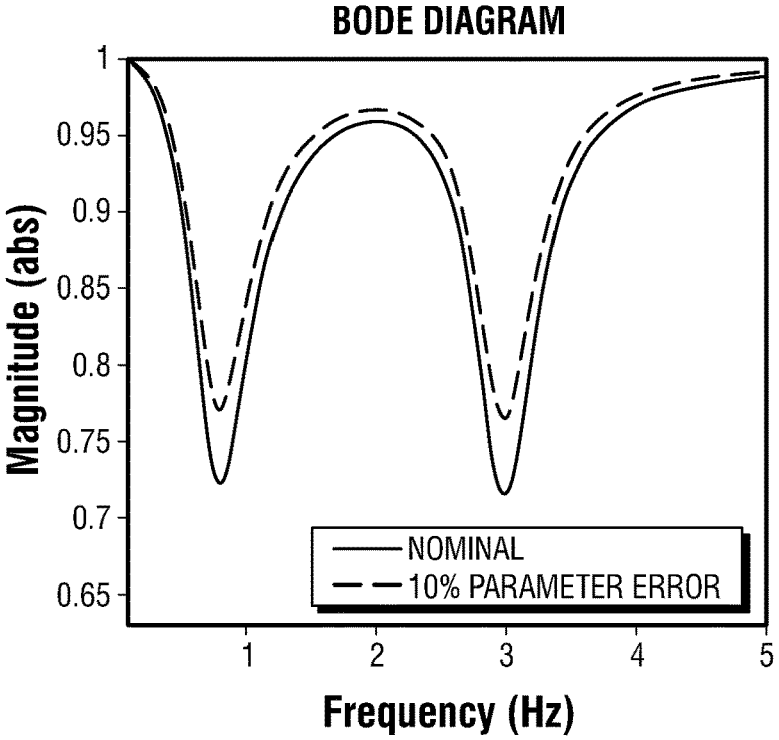
FIG. 9 is a graph showing another example of filtering stick-slip.

Assuming 10% error, as illustrated in FIG. 9, in combination in terms of $GI/c=\sqrt{G_M\rho}$. Since the outer diameter (OD) and inner diameter (ID) of drill pipes may be fairly accurate, second moment of inertia I may be little error. This means G and p may have 10% error each. Results from FIG. 9 illustrate no shift in critical frequencies and Magnitude of attenuation may be slightly affected.

Figure 10:
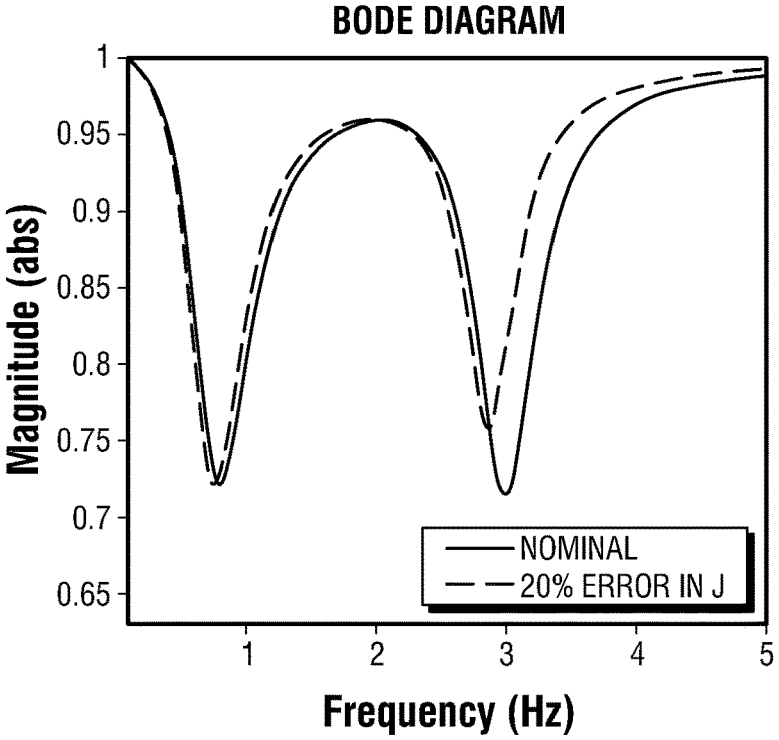
FIG. 10 is a graph showing another example of filtering stick-slip.

Assuming 20% error in J, as illustrated in FIG. 10, in combination in terms of $GI/c=\sqrt{G_M\rho}$. Only slight frequency shift is observed at the first mode. Critical frequency of the second mode is shifted about 0.15 Hz. However, magnitude around the true frequency of second mode is still acceptable.

This method and system for observing stick-slip frequencies and dampening stick-slip across a wide frequency range may include any of the various features of the compositions, methods, and system disclosed herein, including one or more of the following statements.

Statement 1. A method for dampening a stick-slip vibration in drilling, may comprise determining at least one frequency of a stick-slip vibration; determining mechanical properties of the drilling system; producing a torque signal from a controller having at least a second order; controlling a rotational speed of a top drive from the torque signal produced by the controller; and damping stick-slip vibration of the drilling system.

Statement 2. The method of statement 1, further comprising analyzing surface measurements to determine the at least one frequency of stick-slip vibration.

Statement 3. The method of statement 2, wherein the surface measurements comprise revolution per minute, torque, calculation from a model, analyzing downhole measurement data, or any combination thereof.

Statement 4. The method of statements 1 or 2, wherein the mechanical properties comprise equivalent top drive inertia, shear modulus, or density and moment of a drill string.

Statement 5. The method of statements 1, 2, or 4, wherein the controller is implemented with a top drive variable-frequency drive.

Statement 6. The method of statement 5, wherein the top drive variable-frequency drive comprises an internal feedback loop.

Statement 7. The method of statements 1, 2, 4 or 5, further comprising altering the controller with a feedback loop.

Statement 8. The method of statement 7, wherein the feedback loop comprises a filter.

Statement 9. The method of statement 8, wherein the filter is a setpoint filter.

Statement 10. The method of statements 1, 2, 4, 5, or 7, further comprising identifying the at least one frequency of the stick-slip vibration from a surface torque frequency map.

Statement 11. A drilling system may comprise a top drive, wherein the top drive comprises a top drive variable-frequency drive; a drill string, wherein the drill string is attached to the top drive; a bottom hole assembly, wherein the bottom hole assembly is connected to the drill string; a drill bit, wherein the drill bit is connected to the bottom hole assembly; and an information handling system, wherein the information handling system is configured to record at least one frequency from a stick-slip vibration.

Statement 12. The drilling system of statement 11, wherein the top drive variable-frequency drive comprises a controller and wherein the controller is at least a second order that produces a torque signal.

Statement 13. The drilling system of statement 12, wherein a feedback loop is attached to the controller and the feedback loop comprises a filter.

Statement 14. The drilling system of statement 13, wherein the filter is a setpoint filter.

Statement 15. The drilling system of statements 11 or 12, wherein the information handling system is configured to analyze surface measurements to determine the at least one frequency of stick-slip vibration.

Statement 16. The drilling system of statement 15, wherein the surface measurements comprise revolution per minute, torque, calculation from a model, analyzing downhole measurement data, or any combination thereof.

Statement 17. The drilling system of statements 11, 12, or 15, wherein the information handling system is configured to determine one or more mechanical properties include equivalent top drive inertia, shear modulus, or density and moment of a drill string.

Statement 18. The drilling system of statements 11, 12, 15, or 16, wherein the information handling system is configured to identify the at least one frequency of the stick-slip vibration from a surface torque frequency map.

Statement 19. The drilling system of statements 11, 12, 15, or 18, wherein the top drive variable-frequency drive comprise an internal feedback loop.

Statement 20. The drilling system of statements 11, 12, 15, 18, or 19, wherein the information handling system is configured to alter a controller with a feedback loop.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

All numerical values within the detailed description and the claims herein modified by "about" or "approximately" with respect to the indicated value is intended to take into account experimental error and variations that would be expected by a person having ordinary skill in the art.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for dampening a stick-slip vibration in drilling, comprising:

determining two or more frequencies of stick-slip vibration;

determining mechanical properties of a drilling system;

initiating a torque output from a controller using a revolutions per minute (RPM) setpoint, wherein the controller utilizes a second order linear differential equation;

controlling a rotational speed of a top drive from the torque signal produced by the controller; and absorbing the two or more frequencies of stick-slip vibration along a drill string concurrently.

2. The method of claim 1, further comprising analyzing surface measurements to determine the two or more frequencies of stick-slip vibration.

3. The method of claim 2, wherein the surface measurements comprise RPM, torque, calculation from a model, analyzing downhole measurement data, or any combination thereof.

4. The method of claim 1, wherein the mechanical properties comprise equivalent top drive inertia, shear modulus, or density and moment of the drill string.

5. The method of claim 1, wherein the controller is implemented with a top drive variable-frequency drive.

6. The method of claim 5, wherein the top drive variable-frequency drive comprises an internal feedback loop.

7. The method of claim 1, further comprising altering the controller with a feedback loop.

8. The method of claim 7, wherein the feedback loop comprises a filter.

9. The method of claim 8, wherein the filter is the setpoint filter.

10. The method of claim 1, further comprising identifying the two or more frequencies of stick-slip vibration from a surface torque frequency map.

11. A drilling system comprising:

a top drive, wherein the top drive comprises a top drive variable-frequency drive;

a controller configured to receives an input of a revolutions per minute (RPM) setpoint that is processed with at least a second order linear differential equation that produces a torque signal and wherein the RPM setpoint initiates a torque output from the controller;

a drill string, wherein the drill string is attached to the top drive;

a bottom hole assembly, wherein the bottom hole assembly is connected to the drill string;

a drill bit, wherein the drill bit is connected to the bottom hole assembly; and an information handling system, wherein the information handling system is configured to record two or more frequencies of stick-slip vibration and control the drill string to absorb the two or more frequencies of stick-slip vibration concurrently on the drill string by controlling the top drive.

12. The drilling system of claim 11, wherein a feedback loop is attached to the controller and the feedback loop comprises a filter.

13. The drilling system of claim 12, wherein the filter is a setpoint filter.

14. The drilling system of claim 11, wherein the information handling system is configured to analyze surface measurements to determine the two or more frequencies of stick-slip vibration.

15. The drilling system of claim 14, wherein the surface measurements comprise RPM, torque, calculation from a model, analyzing downhole measurement data, or any combination thereof.

16. The drilling system of claim 11, wherein the information handling system is configured to determine one or more mechanical properties include equivalent top drive inertia, shear modulus, or density and moment of a drill string.

17. The drilling system of claim 11, wherein the information handling system is configured to identify the two or more frequencies of stick-slip vibration from a surface torque frequency map.

18. The drilling system of claim 11, wherein the top drive variable-frequency drive comprise an internal feedback loop.

19. The drilling system of claim 11, wherein the information handling system is configured to alter the controller with a feedback loop.

20. A drilling system comprising:

a top drive, wherein the top drive comprises a top drive variable-frequency drive a controller configured to receives an input of a revolutions per minute (RPM) setpoint that is processed with at least a second order linear differential equation that produces a torque signal and wherein the RPM setpoint initiates a torque output from the controller;

a feedback loop attached to the controller and the feedback loop comprises a filter that is a set point filter;

an internal feedback loop attached to the controller that transmits RPM measurements;

a drill string, wherein the drill string is attached to the top drive;

a bottom hole assembly, wherein the bottom hole assembly is connected to the drill string;

a drill bit, wherein the drill bit is connected to the bottom hole assembly; and an information handling system, wherein the information handling system is configured to record two or more frequencies of stick-slip vibration and control the drill string to absorb the two or more frequencies of stick-slip vibration concurrently on the drill string by controlling the top drive.

* * * * *